United States Patent [19]

Deike

[11] 4,339,114

[45] Jul. 13, 1982

[54] FENCING SYSTEM

[75] Inventor: Robert F. Deike, Cheyenne, Wyo.

[73] Assignee: Foresight Industries, Inc., Cheyenne, Wyo.

[21] Appl. No.: 131,034

[22] Filed: Mar. 17, 1980

[51] Int. Cl.[3] ..... E01F 7/02; F16B 7/00

[52] U.S. Cl. ..... 256/12.5; 256/24; 256/34; 256/73; 403/171

[58] Field of Search ..... 256/12.5, 24, 34, 73; 245/11; 404/6; 403/171, 176; 104/279

[56] References Cited

U.S. PATENT DOCUMENTS

| | | | |
|---|---|---|---|
| 1,545,909 | 7/1925 | McKinnon | 256/12.5 |
| 1,768,974 | 7/1930 | Brown | 256/12.5 |
| 1,799,952 | 4/1931 | Brown | 256/12.5 |
| 2,238,417 | 4/1941 | Fredrickson | 245/11 |
| 2,753,156 | 7/1956 | Rieger | 256/12.5 |
| 3,226,091 | 12/1965 | Root | 256/12.5 |
| 3,913,889 | 10/1975 | Nugent et al. | 256/12.5 |

FOREIGN PATENT DOCUMENTS

| | | | |
|---|---|---|---|
| 663568 | 5/1963 | Canada | 256/24 |
| 1459804 | 5/1959 | Fed. Rep. of Germany | 256/12.5 |
| 2157703 | 5/1973 | Fed. Rep. of Germany | 404/6 |
| 912779 | 5/1946 | France | 403/171 |

*Primary Examiner*—James Kee Chi

*Attorney, Agent, or Firm*—Hill, Van Santen, Steadman, Chiara & Simpson

[57] ABSTRACT

A fencing system designed particularly for snow and sand fencing is disclosed. The fencing system consists of a framing structure for supporting a fence face between spaced upright members. The fence face is constructed of a strong flexible mesh such as a mesh formed of re-bar defining rectangular openings in horizontal and vertical rows. Plastic material slats are attached to the mesh extending longitudinally of the mesh from upright to upright, the slats lying parallel horizontal rows spaced from one another by a height approximately equal to the width of the slat. In this manner, approximately 50% of the fence face is open. The bottom of the fence face terminates above the ground by approximately 12" to 16" and the fence face is angled to the base surface approximately 15°.

29 Claims, 23 Drawing Figures

10
11
12
13
14
26
30
31
33
34
35
36
38
38a
40
41
45
46
48
49
50
60
61
62
63
67
67a
67b
67c
68
69
70
71
72
74
75
78
80
81
82
83
84
85
87
100
101
102
103
A
B
C
L
VIII 203
202
201
205
204
200

212
405
215
210
214
207
208
209

13
131
130
136
132

XI
120
20b
13
XII
XII
20b
20a
XI 120
20b
20a
13

121
123
20a
122
13
125
407
403
13
402
408
400
13
401
402
13b
406

FIG. 17
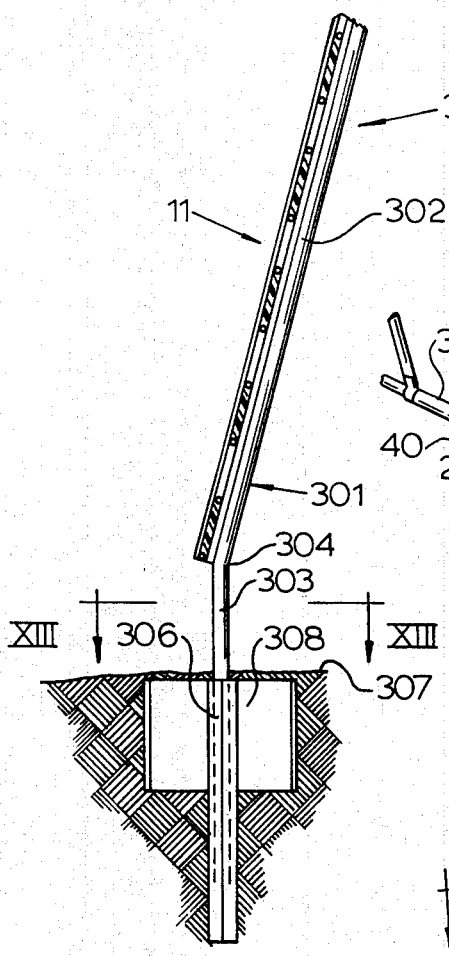
FIG. 23
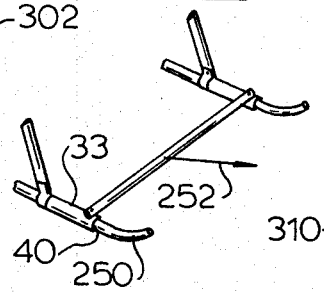
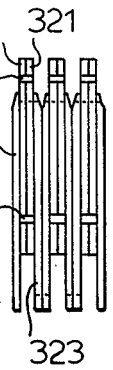
FIG. 18
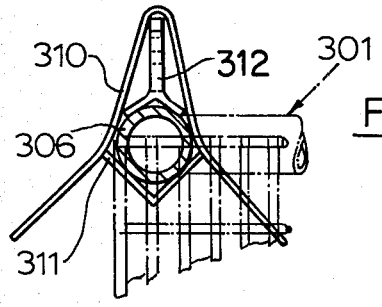
FIG. 19
FIG. 21
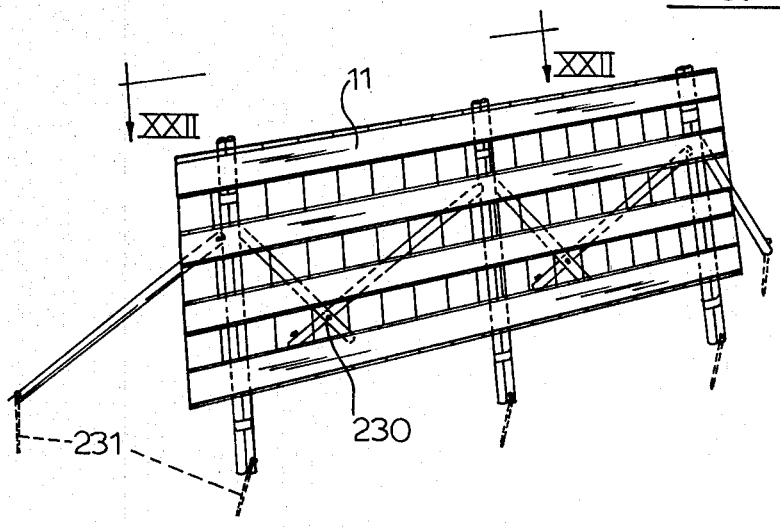
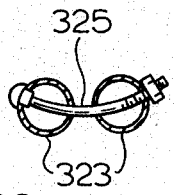
FIG. 20
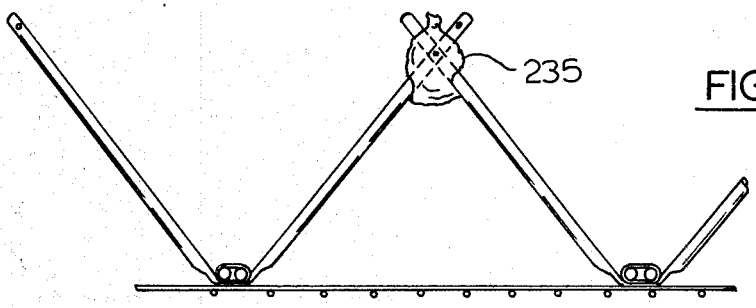
FIG. 22

FENCING SYSTEM

BACKGROUND OF THE INVENTION

1. Field of the Invention

This invention relates to fencing and more particularly to snow and sand fencing.

2. Description of the Prior Art

Snow fencing has existed for at least the past century and is designed primarily to either prevent or encourage drifting. In prevention embodiments, snow is allowed to build up on the windward side of the fence so as to eliminate drifting on the downwind side. In encouragement situations the fence is designed to provide an airflow flow downstream of the fence face in the direction of the prevailing wind which will cause snow to separate from the airstream downstream to build a drift. This invention is directed to the latter type of snow fence. The term snow fence, as used herein, is to be understood to be generic and include both snow and sand fencing of the type which is designed to cause deposit of the particulate, snow or sand, downstream of the fence in the direction of the prevailing wind.

Over the years many different types of snow fence have been suggested from the earliest rigid wooden solid fence to more recently developed roll fencing which utilizes vertical spaced wooden slats interwoven in a chain link or wire mesh fence. All such prior art devices have experienced considerable difficulties which are attributable to varying factors including:

(1) inability of the materials to withstand high winds;
(2) inability of the materials to withstand harmonics created by winds;
(3) inability of the materials to withstand environmental degradation over an accepted life span;
(4) transportability;
(5) difficulties of erection and disassembly;
(6) ineffectiveness in depositing of particulate matter downwind of the fence;
(7) susceptiblity to choking by deposit of particulate member upwind of the fence resulting in burying of the fence; and,
(8) expense.

Originally snow fences were installed vertically, however, it has been known to use angle fences that have vertical portions adjacent the bottom and forward angled portions adjacent the top where the top portion was angled toward the prevailing wind. It has also been known to use rigid framing members framing individual sections of fence so that upon dismantling the snow fence at the end of the season the individual frame members could be stacked. More recently, it has been suggested to use plastics material in the construction of the fence for its light weight qualities, portability and stackability. However, most plastics suggested heretofore have proved to have unacceptably short life spans due to plastic elongation, sag, brittleness or inability to withstand heat.

Other difficulties encountered in snow fencing have included the failure to provide adequate hold down systems to maintain the snow fence in position during high wind condition while allowing the snow fence to be quickly erected and disassembled and, further, providing for movability of the fence during extreme cold weather without the necessity of substantial disassembly.

It would therefore be a considerable advance in the art to provide improved fence designs and constructions capable of overcoming the disadvantages of prior art design.

SUMMARY OF THE INVENTION

It is therefore a principal object of this invention to provide an improved snow fence system which is inexpensive, portable, easily assembled and installed on site, easily disassembled and removed, and of a design effective to cause particulate deposit downstream of the fence without choking or burying the fence by particulate deposit upwind.

The snow fence of this invention consists basically of a fence face and a framing support. The fence face has a plurality of horizontal rows of slats from one another substantially vertically. The slats are supported on a backing member. In the preferred embodiment illustrated the backing member is a metal mesh and the slats are plastics material. I have found that the fence is optimumly constructed with approximately 50% of the face area open. Moreover, I have found that the fence has optimum operating capabilities for deposit of particulate when the slats are approximately 6" in height. Importantly, I have determined that the fence face should be supported at an angle to the vertical from the base of approximately 15°. Further, it has been determined that the snow fence operates best when a gap area is provided below the lowest slat. The gap area should optimumly be approximately 12" to 16".

Within the framework of the above parameters the fence can be constructed in a variety of different systems. I have found it expedient to use a collapsable frame support which allows easy erection and disassembly of the snow fence. In a basic embodiment the framing consists of a series of uprights formed as spaced posts. The posts have a bottom portion which is bent with respect to the upper portion of the posts and which is adapted to be inserted into post support openings in the ground or other base surface. The bend is preferably on the order of 15° so that the fence face, when strung between the uprights, will be supported at the optimum angle of 15° to the base surface. The in ground supports can preferably be constructed as shown in my prior U.S. Pat. No. 4,021,977, granted May 10, 1977, or in my co-pending application Ser. No. 104,291, entitled "Post Support Socket", filed Dec. 17, 1979, the teachings each of which are herein incorporated by reference. In this embodiment, the posts can optimumly be placed approximately every 2.4 meters (7'10") and the fence face can be constructed in individual panels of approximately 2½ or 5 meters (8' or 16'). In this manner, the edges of each face panel will overlap the edges of each adjacent face panel so that there are no gaps along the fence length. Further, in this embodiment, the individual face panels can be affixed to the uprights by hook means carried by the uprights, or the panel tops can be affixed to cable means strung between the uprights. If desired, bottom cables can also be used as can an intermediate backing cable. Additionally, the panels, adjacent their edges, can be affixed to the uprights by tie wires or the like.

In a second preferred embodiment, a self-collapsing framing means is provided consisting of a pair of uprights parallel aligned and banded together by a slip band allowing each of the uprights to rotate with respect to its paired upright. From each upright a strut brace has one end pivotably attached intermediate the ends of the upright and positioned closer to the top of the upright. The strut braces are substantially longer than the upright and are adapted to project backwardly from the upright into an overlap condition with a strut brace from the next spaced upright pair. A curved corner bolt is used to pivotably attach the strut braces to one another adjacent their ends spaced from the uprights. In this manner, a saw tooth fence support line can be provided with the uprights lying in a common plane for support of the face panels and the struts extending backwardly from the uprights at an angle to the face such that the strut braces from adjacent spaced uprights will be joined together approximately midway of the distance between the adjacent spaced uprights and to the rear of the upright's plane by a distance equal to or greater than the height of the uprights. The brace struts then can be affixed to the base surface by weighting systems such as sand bags or by ground driven pins or anchors. In this construction the snow fence is ideally situated to be easily moved since the face panels, attached by means of hooks, tie wires, or the like to the uprights, can be individually disassembled from the uprights, the entire series of saw tooth supports collapsed into a convenient single bundle transported to the new site and then drawn out to the saw tooth format for reattachment of the face panels at the new site.

In yet another preferred embodiment, a free standing framing is provided for the face panels. The free standing framing consists of a pair of parallel spaced sill members with uprights pivotably attached thereto intermediate the ends of the sill. Braces are attached to the uprights intermediate their ends and to the sill intermediate the ends of the sill spaced from the pivotable connection of the sill to the upright. In this manner, the sill, brace and a portion of the upright below the brace connection form an isosceles triangle. One of the connections of the brace, either the connection of the upright or the connection to the sill, is pivotable and the other of the brace connections is detachable.

Spanning the space between adjacent uprights can be top and bottom rail members and, if desired, a diagonal brace member each having their ends affixed to adjacent uprights. In this embodiment, each individual upright pair is collapsable by disassembling one brace connection and folding the upright down adjacent the sill and the brace down adjacent the sill. In this construction the face panels can be permanently attached between adjacent uprights if desired or, a single face panel can be used between three or four adjacent uprights. This embodiment allows the combination face panel and framing members to be collapsed and stacked one atop each other for seasonal storage purposes.

The face panels are preferably formed of a background mesh of welded rod members. I have found it best to utilize concrete reinforcing bar. Gauge sizes utilizable include gauges from 6 to 10. The bar can then be assembled into a rectangular opening mesh. Preferably mesh openings are approximately 6" by 6" (15 by 15 centimeters) with the mesh panels being $2\frac{1}{2}$ or 5 meters (8 ft. by 16 ft.) in length and preferably 1.25 meters (4 ft.) in height. The mesh panels are conveniently formed as laid up welded mesh where the rod members running in the vertical direction are laid over the rod members running in the horizontal direction and welded thereto by means such as spot welding. By utilizing a 4 ft. high mesh sections, snow fence of 4 ft., 8 ft., 12 ft. and 16 ft. can conveniently be provided by hinging together along the lengths thereof two or more 4 ft. high sections.

In one preferred embodiment, I have formed a channel mesh where the horizontal bars are sandwiched between vertical bars to define horizontal longitudinally open channels.

Preferably, the slats of the fence face are formed of sheet plastic dimensioned to be received between the horizontal bars substantially covering the space between adjacent horizontal bars. It has been found preferable to utilize a high density thermoplastic. A particularly effective plastic has been determined to be a high density polyethylene known as HDPE3406 obtainable from Phillips Products, Inc., a division of Phillips Petroleum Corporation. Such plastics are ASTM spec having a cell classification of PE355433-C. The plastic is sheet formed to individual sheets of $\frac{1}{8}$" thickness. The plastic slats can be attached to the mesh background by interweaving the plastic with the mesh, by clipping the plastic to the mesh or by sliding the plastic in the channels formed in the channel mesh. It has been found preferable to use a loose clip allowing for different expansion and contraction coefficients between the plastic and the mesh.

In order to provide strengthening of the framing structure, I have utilized round tube. For joining where the tube ends are joined to adjacent tube members, I have channel formed the ends of the tube by collapsing the ends in a mandral die to form U-shaped cross-section channel at the ends of the tubes.

I have also found that the snow fence performs best when an open choke area is provided below the bottommost slat. Experimentation has shown that the choke area should be approximately 30 cm to 40 cm (12" to 16") in height above the base surface. The choke area provides for improved aerodynamics of air flow through, under and over the angled fence face providing for improved particulate deposit downwind of the fence.

It is therefore a specific object of this invention to provide an improved snow fence having a fence face formed of a metal mesh with horizontal longitudinally extending rows of spaced slats, the slats being dimensioned in position with respect to one another to block approximately 50% of the face.

It is another and more specific object of this invention to provide an improved snow fence having a fence face supported between spaced uprights, the fence face formed as a metal mesh with longitudinally extending horizontal plastic slats affixed to the mesh, the slats having a width of approximately 15 cm (6") and being spaced from one another to block approximately 50% of the fence face, the face being attached to the uprights at an angle of approximately 15° to the base surface vertical with a bottom slat positioned above the base surface approximately 12" or more.

It is yet another specific object of this invention to provide an improved snow fence having a fence face with horizontal spaced slats affixed to a mesh background supported by easily disassemblable spaced uprights, the uprights being positioned at an angle of approximately 15° to a base surface vertical.

It is yet another specific object of this invention to provide an improved snow fence having a fence face constructed of a rod mesh backing and horizontally extending vertically spaced plastic slats blocking approximately 50% of the fence face, the fence face being supported by a collapsable framing with a bottom slat positioned approximately at least 30 cm above the base surface, the frame constructed of tubular uprights and pivotable brace members affixed to the uprights.

It is yet another specific object of this invention to provide an improved snow fence having a fence face constructed of a rod mesh backing and horizontally extending vertically spaced plastic slats blocking approximately 50% of the fence face, the fence face being supported by a collapsable framing with a bottom slat positioned approximately at least 30 cm above the base surface, the frame constructed of tubular uprights and pivotable brace members affixed to the uprights, the uprights being pivotably attached to base sill members and the braces having one end pivotably attached to one of the base sill or upright and the other end attached to the other of the sill or upright by means of an easily disassemblable connection.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 17 is a fragmentary sectional view of the bottom portion of another embodiment of a support structure for the snow fence of this invention.

FIG. 18 is a plan view of yet another embodiment of a support structure of the snow fence of this invention in a collapsed position.

FIG. 19 is a sectional view taken along the lines xiii—xiii of FIG. 17.

FIG. 20 is a sectional view of a connection of the braces of the embodiment of FIGS. 18, 21, and 22.

FIG. 21 is a perspective view of a snow fence according to this invention illustrating the support structure of FIGS. 18 and 22.

FIG. 22 is a plan view taken along the lines xxii—xxii of FIG. 21.

FIG. 23 is a fragmentary view of an attachment to the support structure of FIGS. 1 and 2 providing for easy transportability of the snow fence.

DESCRIPTION OF THE PREFERRED EMBODIMENTS

Figures 1, 2, 3, 4, 5, 7, 8:
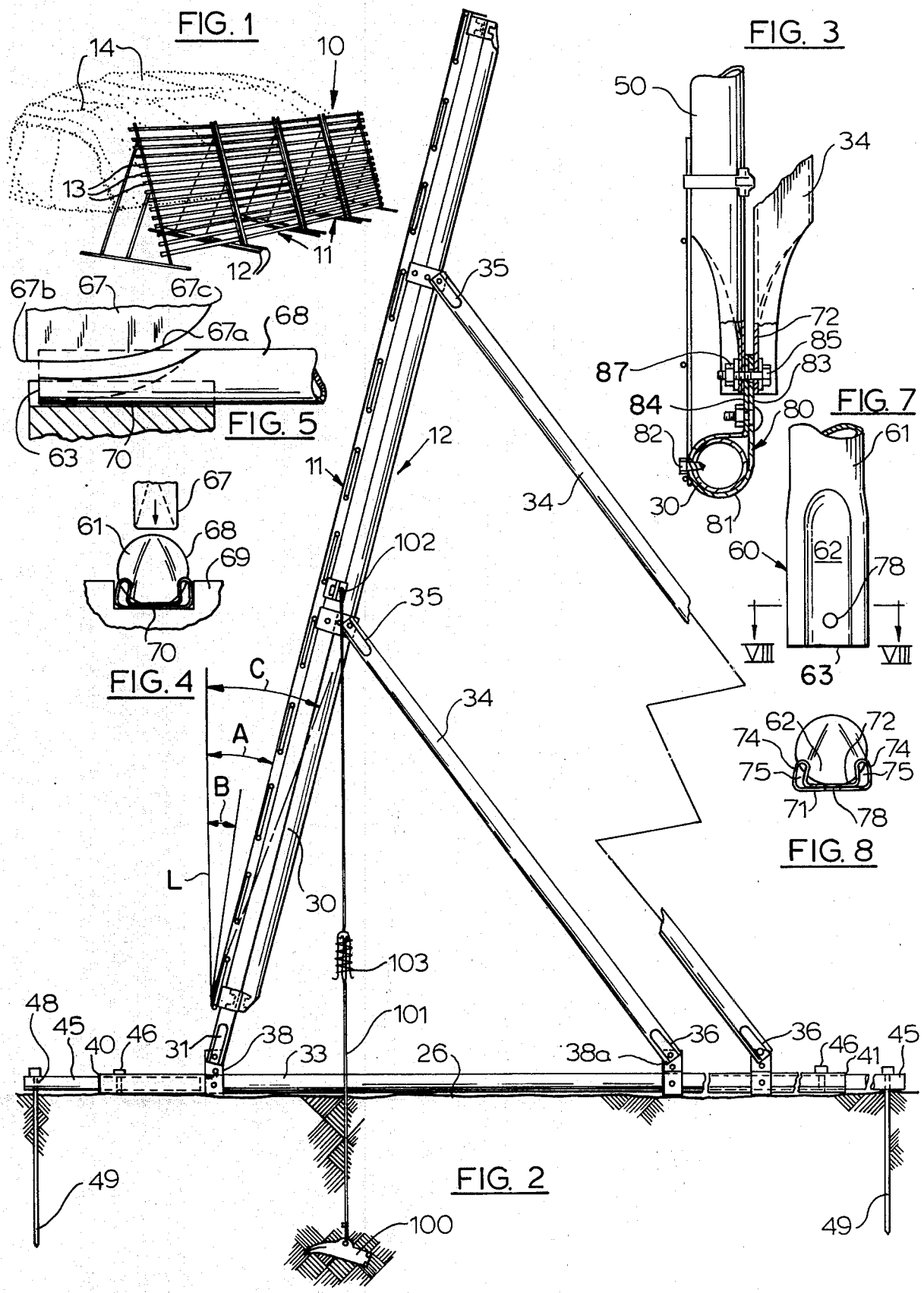
FIG. 1 is a perspective view of a snow fence constructed according to this invention.
FIG. 2 is a side plan view of one embodiment of the snow fence of this invention.
FIG. 3 is an enlarged framentary, partially sectional view of a tubing connection of the support frame of a snow fence of this invention.
FIG. 4 is a diagrammatic view of a mandrel die forming device for end forming the tubes of the framing of the snow fence of this invention.
FIG. 5 is a side plan view partially in section of the mandral die of FIG. 4.
FIG. 7 (on page 1 of the drawings) is an enlarged fragmentary end view of a framing tube member according to this invention.
FIG. 8 is a sectional view taken along the lines VIII—VIII of FIG. 7.
Figure 9:
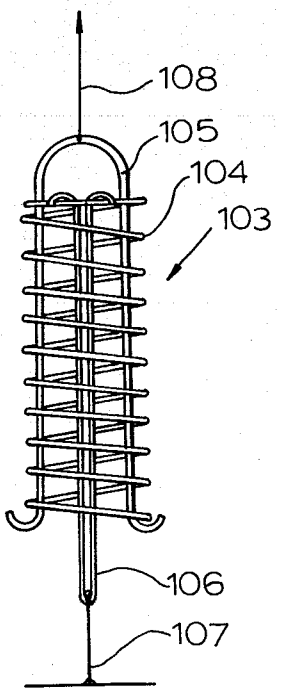
FIG. 9 is an enlarged drawing of an anchor tension spring used in the embodiment of FIG. 2.

As shown in FIG. 1, a snow fence indicated generally at 10 consists of one or more fence face members 11 and a plurality of spaced supporting members 12. The snow fence face has a plurality of horizontally extending, vertically spaced slats 13 which block off horizontal sections of the fence face 11. This type of snow fence is utilized to deposit a drift 14 or snow or sand behind the fence line in the direction of travel of the prevailing wind.

Figure 6:
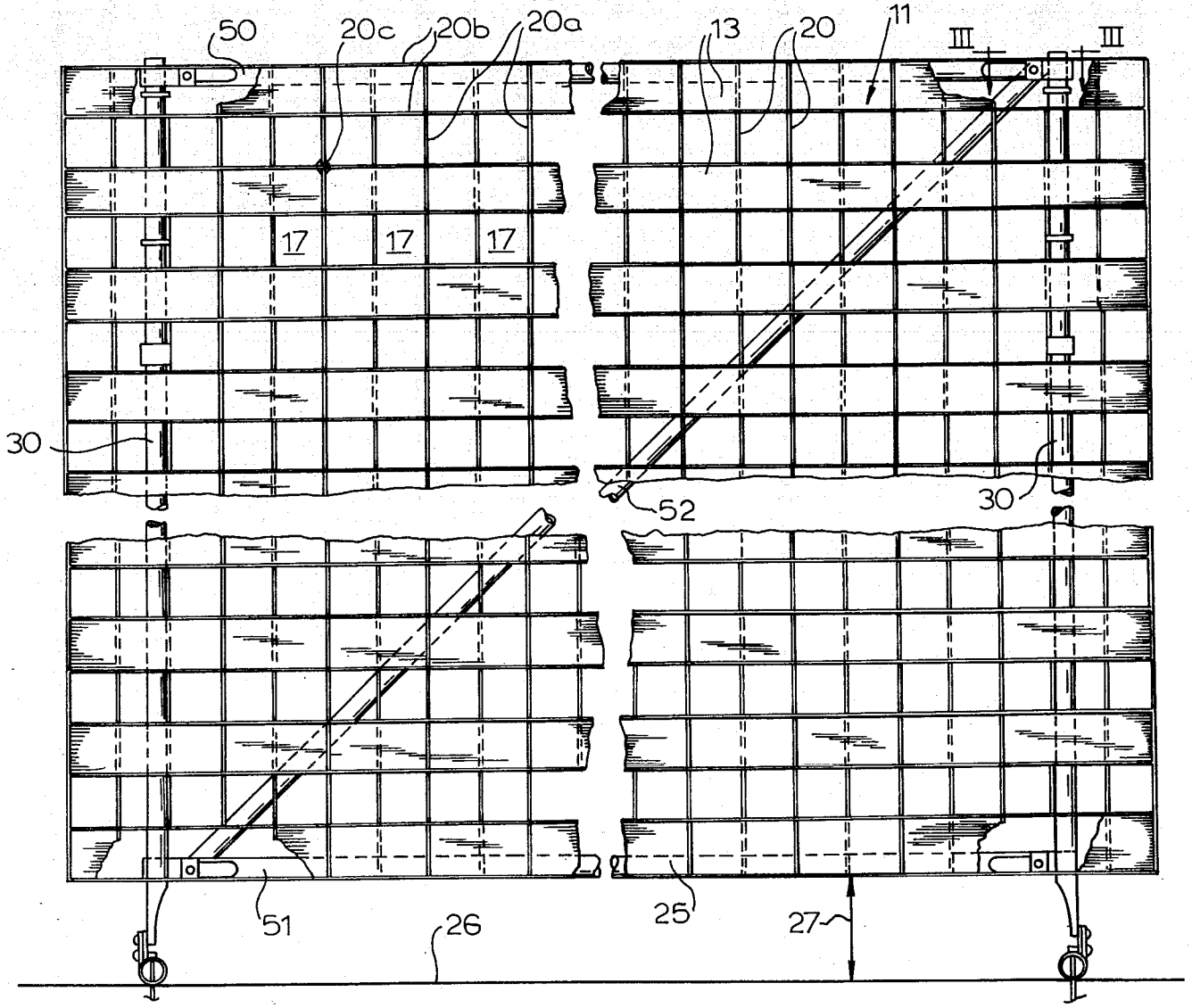
FIG. 6 is a plan view, partially in section of one embodiment of a snow fence according to this invention.

As illustrated in FIG. 6, the fence face 11 consists of individual panels formed of a mesh backing 20 which has the slats 13 affixed thereto. The mesh is formed of a strong but flexible material. It has been found that from 6 to 10 gauge re-bar can appropriately be utilized. Flexibility is important because snow fences are used in high wind situations where a rigid strut member will be vibrated by the wind to an extent that haromonic build up of the vibrations can cause substantial distruction of a rigid mesh. Therefore flexibility is believed to be an important criteria for the individual rod members of the mesh. On the other hand, it is important that the individual rod members be sufficiently strong to retain structural integrity when subjected to high load forces encountered in use. In the embodiment shown in FIG. 6, the rods have been formed into a grid of horizontal and vertical rows with the vertical rows overlying the horizontal rows such that the vertical rods **20*a* each overlie horizontal rows 20*b*. The rods are welded together at the junctures 20*c* forming rectangular openings 17. In the preferred embodiment, the slats 13** have a length which is variable depending upon the size of the fence face and a width preferably between 4" and 8" (10 to 20 cm). Testing has determined that the ideal dimensions for the fence face call for a 6" (15.25 cm) by 6" (15.25 cm) opening and a slat size dimensioned to be received between the rods. For standard size rods, a slat of 5 $\frac{5}{8}$" width is acceptable.

The slats 13 are positioned to block every other row of openings 17 such that the fence face is approximately 50% open and 50% slat blocked. The bottommost slat 25 is preferably positioned above the support surface 26 between 30 to 40 cm (12" and 16") thus providing a choke opening 27.

The face panels can be made to uniform size such as, for example, 4 ft. tall by 8 ft (1.25 to 2.5 m) long. Other sizes may be chosen, however, it has been found acceptable to manufacture snow fences having fence face heights which are multiples of 4 ft. (1.25 m) and lengths which are multiples of 8 ft. (2.5 m).

As has previously been mentioned, the slats 13 are preferably formed of a plastics material. High density polyethylene has been found acceptable. $\frac{1}{8}$" (30 mm)

thick sheet material can be used in the formation of the slats.

As best shown in FIGS. 2 and 6, in a first preferred embodiment, the fence face panel 11 is supported by a framing structure 12 formed of metal tubing. The structure includes uprights 30 having bottom ends 31 attached to tubular sills 33. Brace members 34 have their ends 35 and 36 attached respectively to the upright 30 intermediate its ends and to the sill 33 intermediate its ends spaced from the connection 38 of the bottom end of the upright 30 to the sill 33.

The sill 33 may preferably be formed with open ends 40 and 41 which may receive telescoping smaller diameter tube members 45 so that the length of the sill may be expanded as desired. A pin 46 received in an opening in the sill 33 can extend through corresponding openings in the telescoping tubes 45 to lockably position the degree of extension of the tubes 45. Tubes 45 may be provided with openings 48 adjacent their outermost ends for receipt of anchor pins 49 which, in embodiments not using the extensions, can be extending through the sill 33 at the position of the pins 46 to anchor the sill directly to the ground.

As illustrated in FIG. 6, the uprights 30 may be connected together by top 50 and bottom 51 horizontal rails to define a rectangular frame member for receipt and attachment of the fence face panel or panels. A cross-brace 52 can extend from adjacent the bottom of one upright to adjacent the top of the other upright. In the embodiment illustrated in FIG. 6, the ends of the cross-brace 52 are attached to the horizontal rails adjacent the uprights.

As shown in FIG. 2, the fence face panel 11 is inclined at the angle A from the line L normal to the sill 33 and can be swung to a lesser angle B or a greater angle C. Angle A, as shown, is 15°, while the lesser angle B is 10° and the greater angle C is 20°.

I have found in order to strengthen the tubing at the connection, it is preferable to draw the tubing to a channel shaped cross section adjacent the ends. As shown in FIG. 7, the ends 60 of the tubes 61 are die formed to produce a sloping central depression 62 open to the free end 63 of the tube. The depression is formed with a mandrel member or a male die 67 shown in FIG. 4 which presses against the outer diameter 68 of the tube 61 while the tube is received in a female die member 69 having a channel opening 70 slightly larger than the diameter of the tube. The male die 67 is forced against the tube until the tube is crushed so that opposite sides of the tube contact one another at the end 63 as shown in FIG. 8 at 71. The sides of the channel shaped end thus rise above the bottom 72 of the depression 62 in a U-shaped cross-section. The upstanding leg sides 74 of the U-shaped cross-section are preferably formed with gaps 75 between the metal folds at the end 63. This has been found to provide extra strength to the end of the tube. A connection opening 78 can then be formed through the tube at the bottom 72 of the channel 62.

As best shown in FIG. 5, the male member of mandrel 67 has a curved bottom **67*a* which tapers upward from a full height end 67*b* to a reduced height end 67*c*. The mandrel is also tapered in cross-section as illustrated by the dotted lines in FIG. 4. In this way the mandrel will form a channel which has its greatest width and depth at the end 63** of the tube and which after, if desired, maintaining a constant depth and width for a distance away from the end will thereafter reduce in both width and depth to the point of full diameter of the tube spaced from the end.

As shown in FIG. 3, the tubing can be easily attached together at the connections by strap connections. A metal strap member 80 is formed with a central part-cylindrical portion 81 received around one of the uprights 30. A self-tapping screw 82 can lock the band 80 to the upright 30. Legs 83 and 84 extend outwardly from the tube receiving the cylindrical portion of the band and can be positioned offside to one side or the other of the tube 30. Bolts 85 extending through the bottoms 72 of tubes 34 and 50 and through openings in the legs 83 and 84 terminate in fastening nuts 87. In the device illustrated in FIG. 1, the fastening of FIG. 3 can be used at the top of the upright when the brace 34 is to be attached at the point of attachment of the top rail 50. In other embodiments, where intermediate attached braces are used, such as shown in FIG. 2, additional straps 80 can be provided at desired positions along the length of the uprights. Similarly, the connection of the upright to the sill at 38 can employ similar straps 80 as can the connections of the braces 34 to the sill 33 and the connection of the diagonal brace 52 to the rails 50, 51 or, if desired, to the upright 30. In particular embodiments, where easy disassembility is required, other fastening means than bolts and nuts can be utilized or, for example, the nut can be an easily grasped wing nut. For more permanent frames rivets can be used.

The framing structure shown in FIGS. 2 and 6 is easily folded for storage by removing one of the brace connections, either at the end 35 or the end 36 and thereafter collapsing the upright into parallel relationship with the sill and folding the brace about its other connection into parallel relation with the sill. In order to provide for compactness of storage, the legs 83, 84 of the connection 38 can be positioned to one side of the sill whereas the legs of the connection **38*a*** of the brace can lie to the other side of the sill.

As shown in FIG. 2, in order to positively anchor the frame to the support surface 26, a ground anchor device 100, which may be of the type shown and described in my U.S. Pat. No. 4,044,513, issued Aug. 30, 1977, the teachings of which are herein incorporated by reference, can be utilized. Cabling 101 can then extend from the anchor device to a point of connection 102 with the upright. A compression spring best shown in FIG. 8, can be utilized to allow the framing to move with respect to the anchor 100 as a ground heave occurs. The spring 103 includes an entrapped coil 104 and cable attaching straps 105 and 106 which engage opposite ends of the coil spring and extend through the coil spring for attachment to cable lengths 107, 108 such that as the cables 107, 108 are drawn apart, the spring 104 is collapsed.

After erection of the frame, the face panel can be attached to the framing by suitable fastening means such as, for example, hooks, tie wires, and the like.

Figures 10, 11, 12, 13, 14, 15, 16:
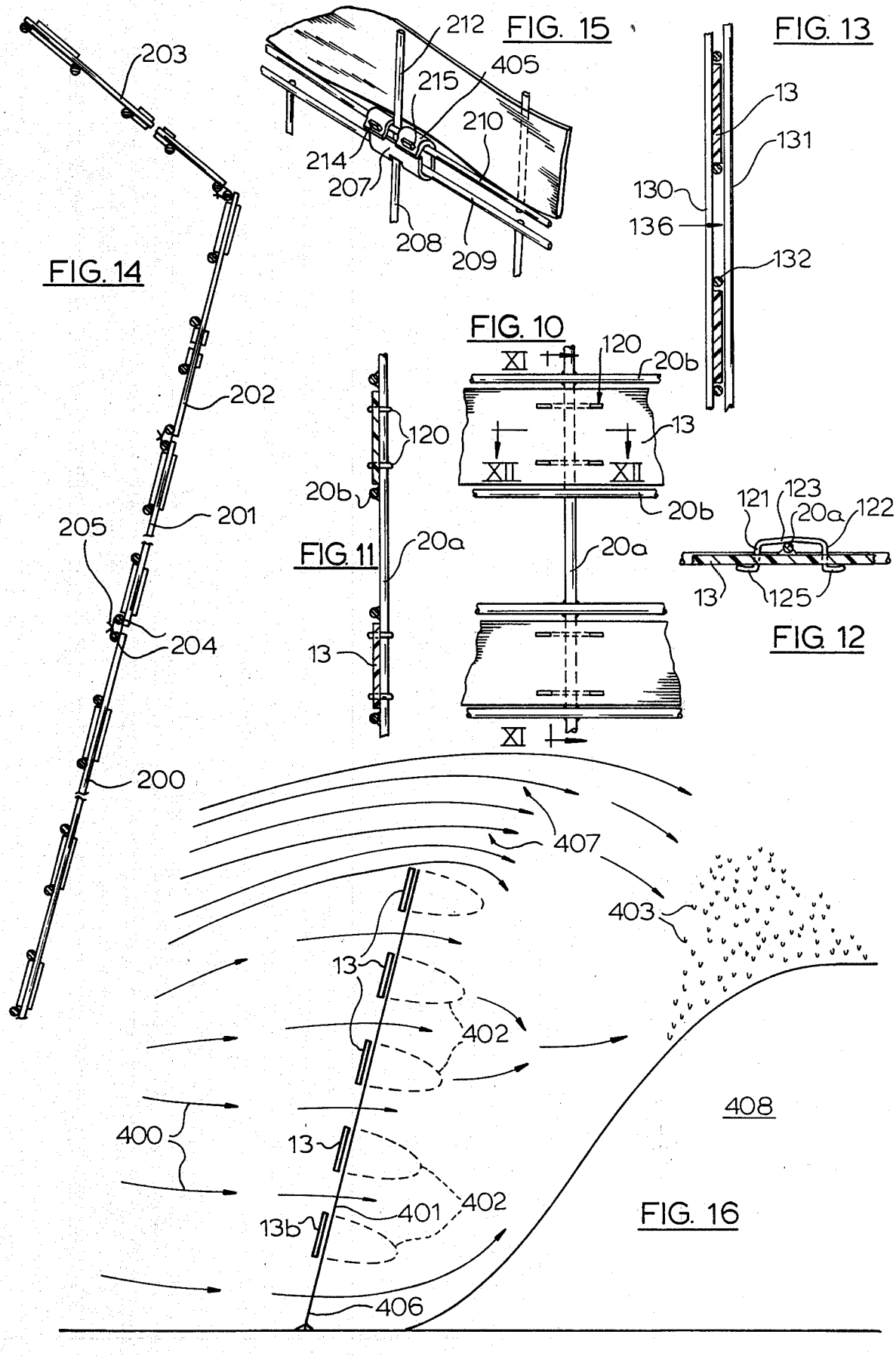
FIG. 10 is a fragmentary view of a portion of the fence face illustrating attachment of the slats.
FIG. 11 is a sectional view taken along the lines xi—xi of FIG. 10.
FIG. 12 is a fragmentary sectional view taken along the lines xii—xii of FIG. 10.
FIG. 13 is a view similar to FIG. 11 illustrating another embodiment of the fence face of this invention.
FIG. 14 is a side sectional view of a multi-panel fence face according to this invention.
FIG. 15 is an enlarged fragmentary view of an attachment of adjacent fence face panels.
FIG. 16 is a schematic diagrammatic view of the particulate deposit action of the snow fence of this invention.

As illustrated in FIG. 6, the slats 13 may be affixed to the mesh by weaving the slats over and under the vertical rods **20*a* while leaving the slats positioned between horizontal rods 20*b*. Alternatively, the slats 13 may be affixed to the rods by staples. As shown in FIGS. 10 through 12, the slats 13 can be stapled to the vertical rods 20*a* by oversized staples 120. The staples include legs 121 and 122 interconnected by a bight section 123. The legs terminate, after passing through the slat 13 in inturned or outturned ends 125. The bight section entraps the rod 20*a* intermediate the legs 121 and 122. The legs 121, 122 are spaced apart by a distance considerably greater than the diameter of the rod 20***a*. In this manner, movement of the slat 13 with respect to the rod 20*a* can occur so as to accomodate different coefficients of expansion of the mesh and the slats.

Additionally, as shown in FIG. 13, the mesh can be formed with overlying 130 and underlying 131 rows of parallel vertical rods positioned on either side of intermediate 132 horizontal rods and welded thereto on both sides of the intermediate rod. This defines channels 136 which are opened along the longitudinal length of the mesh defined between the overlying rods 130 and the underlying rods 131 and the intermediate rods 132 at the tops and bottoms of the channel. The channel can then be dimensioned to receive the slats 13 which can be slid inwardly from an end of the mesh. In this construction the slat can be attached to the mesh or adjacent the side edges of the mesh and the slat will be sufficiently held in intermediate sections due to the backing on both sides of the slat by the underlying and overlying rods.

As illustrated in FIGS. 14 and 15, the individual fence face panels can be constructed in relatively convenient sizes, such as, for example, the aforementioned 4″ by 8″ panels. Where it is desired to employ an overall face panel larger, smaller segments can be conveniently attached to one another about pivot connections. As shown in FIG. 14, panel sections 200, 201, 202 and 203 are attached together about the horizontal respective top and bottom rods 204 by clamps 205 to make an entire four panel fence face. The clamp 405 is shown in FIG. 15 and consists of a base section 207 which straddles a vertical rod 208 at its attachment to a horizontal rod 209 of the lower segment on one side of the rod 208. Legs depending from the base section 207 extend under the rod 209 and are curved thence upwardly around the parallel horizontal rod 210 of the upper base section thence around the top of rod 210 back to the base 207 on either side of the vertical rod 212 which is positioned above the rod 208. Tabs 214 affixed to base 207 are receivable in slots 215 at the ends of the legs to lock the bracket to the panels. With this type of construction, the individual panels can be folded to overlye one another in an accordian pleat fashion so that a large face panel, for example, 16′ by 8′ can be stored in a small space of 4′ by 8′. This greatly facilitates transportability and storage of the system since the frame members can be individually collapsed for easy storage.

As shown in FIG. 17, in an alternative embodiment, the framing 300 can consist of a plurality of spaced apart individual uprights 301 formed with upper sections 302 inclined at an angle to bottom sections 303. The fence facing 11 is affixed to the upper portions 302 by suitable fastening means. The lower portion, 303, below the bend 304 have lower sections 306 adapted to be inserted into openings in the ground or other support surface 307. As illustrated, a ground anchor socket 308 may be employed for releasably locking the upright 301 in the ground. The socket illustrated is of the type shown in my aforementioned U.S. patent and co-pending patent application. When systems of this type are employed, the necessity or desireability of top and bottom rails and diagonal bracing can be eliminated in many installations. The uprights can be spaced along the length of fence as needed with shorter spacing being employed where higher wind conditions are expected. In such instances, three, four or more uprights may be employed for the support of each fence face panel.

FIG. 19 illustrates the locking ability of such stancion system wherein the bottom section 306 of the upright is received between a fin 310 and an angle 311 affixed to the fin. An insertable and removable wedge member 312 locks the upright tube in position in the stantion. By so doing this allows vertical positioning of the upright while at the same time restraining against rotational movement.

FIGS. 18 and 20 through 22 illustrate another embodiment of this invention utilizing a saw tooth collapsing framing system. A pair of uprights 320 and 321 are banded together in parallel relation by bands 322 which allow individual rotation of the uprights 320, 321 with respect to one another. Pivotably attached to each of the uprights adjacent their tops are brace members 323, the brace members being attached on outside faces of the uprights. Each pair of uprights and associated braces forms an individual tripod support. Adjacent tripod supports are attached to one another adjacent the bottoms of neighboring braces by a curved fastening means 325 illustrated in FIG. 20. This allows relative rotation of adjacent bracing members to occur such that they can be collapsed into a flat condition illustrated in FIG. 17 and expanded into an overlapped condition as illustrated at 230 of FIG. 21. With the uprights of adjacent tripods moved laterally of one another and with the braces positioned to the rear of the uprights, an angled face support is provided as illustrated in FIGS. 21 and 22. Fastening pins 231 can be used to fasten the support structure to the ground or other support surface and fence face panels 11 can be affixed to the uprights be convenient fastening means. For temporary installation, sand bags or the like, as illustrated in FIG. 22 at 235, can be employed to hold the snow fence in position. The support system can be assembled in any desired multiple of tripod structures.

FIG. 23 illustrates a modification of the framing system of FIG. 2. Where it is desired to first deposit a drift of snow and to then move the snow fence onto the drift to cause a further depositation partially on top of the drift and partially on the far down slope of the drift in order to build extremely wide drifts, sled runners 250 can be provided for insertion into the ends 40 or 41 of the sills 33. Brace members 252 can be attached to the runners 250 as parts thereof or can, conveniently span between adjacent sills and be pinned through the openings provided for pins 46. In this manner an entire fence line can be easily transported to a new position.

As shown in FIG. 1, a plurality of framing supports can be utilized to support a single face panel. Alternatively, individual face panels can be attached or semi-permanently affixed to two or three framing supports with adjacent panels in a snow fence line being attached to independent framing supports. In such instances, or where adjacent panels are affixed to otherwise interconnected framing supports, it has been found desireable to extend the panel frames beyond the support at the sides as illustrated in FIG. 6. This allows an overlap of fence faces to be provided between adjacent supports so that no gaps occur even if one frame section is positioned on a slope with respect to the other frame section such that the uprights converge or diverge from one another in the plane of the fence.

I believe that a partial explanation for the superiority of the disclosed fencing system is the aerodynamic forces created by the system. As shown schematically in FIG. 16, each of the slats provides a barrier to air flow in the direction of the arrows 400. In this manner, as air passes through the openings 401 between the slats 13, the air pressure and velocity is momentarily increased. Downstream of the slats low pressure areas 402 are provided. As the air stream passes beyond the low pressure areas, the change in velocity and in then existing pressure causes particulate 403 to fall out of the air stream in a known fashion. The provision of the open choke area 406 below the bottommost slat **13*b* prevents snow accumulation buildup on the upstream side of the snow fence. Due to the inclination of the fence from the support surface, ideally approximately 15%, an uplift overflow air blanket 407 is created which extends above the fence and to the backside of the fence. This has an additive effect in maintaining the velocity and pressure change effect of the air which has passed through the openings 401 to assist in assuring that the particulate fallout will occur in the drifted area building a drift mound 408**. It has been empirically determined that snow depositation with a fence of this type will be of a lesser amount if the face is disposed vertically and will increase in deposited amount as approximately an angle of 15° inclination is reached. As the angle of approximately 15° is passed, the depositation of snow declines. In different situations it is believed that ideal angles may be between 10° and 20°.

Empirical testing of snow fences constructed according to the invention have shown the effectiveness of such systems in accumulating desired downstream drifting of snow. Certain empirically designed formulas have emerged from such studies. First, the minimum fence length for effective drift accumulation has been found to be thirty times the height of the individual face panels. Second, where it is desired to place one fence behind the other to increase the depth of drifting, the minimum distance between the parallel fence rows should by thirty-five times the height of the face panels. Thirdly, the maximum practically attainable drift height is 1.2 times the height of the face panels. After achieving that height, the face of the drift will move towards the backside of the panel eventually blocking the choke area. When this occurs, additional depositation necessary to further build the height of the drift will not occur. Initially, it has been found that the drift will begin to form a distance behind the fence line approximately equal to the height of the face panel. Further, it has been found that the point of greatest height of the deposited drift bank will occur at a distance approximately 2 to 3 times the height of the face panel behind the fence line with a gradually decreasing slope thereafter. Further, it has been determined that the best design will have from 40% to 60% of fence face above the bottom open to air passage.

It can therefore be seen from the above that my invention provides an improved snow fence consisting of a fence face formed of a strong flexible rod mesh defining horizontal rows of rectangular openings with alternate horizontal rows blocked by a high density polyethylene slat affixed to and carried by the mesh in a configuration such that approximately 50% of the fence face is open to the passage of air. The fence face is supported on a support structure at an angle of approximately 15° to the base of the support structure. I have shown various embodiments of easily collapsable support structures and anchoring devices therefore and improved strengthening devices for tubular support structures.

Although the teachings of my invention have herein been discussed with reference to specific theories and embodiments, it is to be understood that these are by way of illustration only and that others may wish to utilize my invention in different designs or applications.

I claim as my invention:

1. An open bottom fence providing a barrier of only about 40 to 60% of its total area above the bottom and effective to create downstream air flow from an upstream particulate material laden wind that will deposit particulate material in a downstream drift initially spaced behind the fence at a distance about equal to the fence height and building up to a height greater than the fence height which comprises a frame having longitudinally spaced supports, means holding said supports upright at a rearwardly inclined angle of from about 10° to about 20° to a line normal to a base surface on which the fence is installed, an open mesh face secured to said uprights spanning the space therebetween and terminating substantially above said base surface, said face composed of intersecting rows of rods defining openings therebetween, spaced parallel slats secured to said rods covering some of said openings with spaces therebetween leaving open from about 40% to about 60% of the area of said face, and the termination of said face substantially above said base surface providing an unobstructed choke opening cooperating with said 40% to 60% open face area of the mesh face to create said downstream air flow.

2. The fence of claim 1 wherein the slats are ribbons of plastics material.

3. The fence of claim 1 wherein the slats are about four to eight inches wide.

4. The fence of claim 1 wherein said means hold said supports upright at an angle of about 15° to a line normal to the base surface on which the fence is installed.

5. The fence of claim 1 wherein said slats cover about 50% of the area of the mesh face.

6. The fence of claim 1 wherein the open mesh face terminates about twelve to sixteen inches above the base surface.

7. The fence of claim 1 wherein the bottom of the mesh face is covered by a slat.

8. The fence of claim 1 wherein the slats extend horizontally and continuously between adjacent uprights and include a top slat at the top of the mesh face and a bottom slat at the bottom of the mesh face.

9. The fence of claim 1 wherein the mesh face is formed of welded together rods with parallel longitudinally extending rows of overlying rods welded to transverse parallel rows of underlying rods and provides a panel of a size to span adjacent uprights.

10. The fence of claim 1 wherein the slats are stapled to the rods.

11. The fence of claim 1 wherein the slats are interwoven with said mesh face.

12. The fence of claim 1 wherein the mesh face is composed of overlying spaced parallel rows of rods, underlying spaced parallel rows of rods aligned with said overlying rods and intermediate spaced parallel rows of rods at right angles to the aforesaid rows of rods, weld bonds securing said rods in fixed relation to define channels between the overlying and underlying rows bounded by said intermediate rods, means securing the intermediate rows of rods to said uprights whereby said channels have longitudinal lengths between said uprights and said channels receiving said slats.

13. The fence of claim 1 wherein said slats are ribbons of high density plastics material.

14. The fence of claim 1 wherein hinges connect said longitudinally spaced supports and said means holding said supports upright, and brace members have opposite ends connected to said supports and said means with at least one end of each brace member being detachable with the other end being pivotably connected to either said supports or means holding said supports.

15. The fence of claim 1 wherein the frame includes top and bottom rigid rails extending between and affixed to said supports.

16. The fence of claim 1 wherein said means holding said supports upright are sill members adapted to rest on the ground and anchors are provided to secure the sill members to the ground.

17. The fence of claim 1 including diagonal rigid brace members affixed to the bottom of one upright and the top of the adjacent upright behind said mesh face.

18. The fence of claim 1 wherein said longitudinally spaced supports have bottom end portions extending below said mesh face and ground anchors receive said bottom portions in vertical upright position whereby said mesh face is inclined at said angle from about 10° to about 20°.

19. The fence of claim 1 wherein the mesh face is composed of a plurality of panels and the rods of adjacent panels are hinged together to accommodate folding of the panels into a compact flat stack.

20. A snow fence comprising framing means for supporting a fence face at a rearwardly inclined angle to a base surface on which the fence is to be mounted, said framing means including longitudinally spaced uprights having top portions projecting at a rearwardly sloping angle relative to vertical bottom portions, means providing vertical openings in the base surface receiving said bottom portions of said uprights, a fence face spanning adjacent uprights, said fence face including a plurality of vertically spaced horizontal rows of rods and intersecting longitudinally spaced vertical rows of rods secured to the horizontal rows at points of intersection, means attaching said fence face to said uprights to present the face at a rearwardly inclined angle determined by the angle of the top and bottom portions of the uprights, vertically spaced horizontal slats blocking alternate rows of said mesh face including a bottom slat at the bottom of the face and a top slat at the top of the face, said uprights holding said bottom slat above the base surface to provide an open chute about 12 inches high, and from about 40% to about 60% of the area of said face between said top and bottom slats being open to cooperate with said open chute for building up a drift in spaced relation behind said fence.

21. A snow fence comprising a fence face and a support structure, said support structure having a plurality of pairs of parallel side-by-side uprights, means banding together the uprights of each pair, said means allowing relative rotation of said uprights about their axes, a plurality of elongated brace members each having one end swingably pinned to an upright of each pair and the other end swingably pinned to an adjacent brace member whereby said support structure may be rotated and swung from a collapsed compact position with said uprights and braces in abutting relation to an open position receiving the fence face with the pairs of uprights in longitudinally spaced relation and the braces extending rearwardly between spaced adjacent pairs.

22. The snow fence of claim 21 wherein the other ends of the adjacent brace members are pinned together by a curved fastening member.

23. The snow fence of claim 21 wherein said other ends of the brace members are cylindrical and a curved bolt extending through the cylindrical ends swingably pins the brace members together.

24. The snow fence of claim 21 wherein the fence face is composed of a metal rod mesh and a plurality of vertically spaced horizontal rows of plastics material slats block about 50% of the face area.

25. A snow fence which comprises a frame structure having a pair of longitudinally spaced elongatd sill members adapted to rest on the ground, a pair of uprights each having a bottom end swingably pinned to a sill intermediate the ends of the sill, a pair of elongated brace members each having one end swingably pinned to an upright intermediate the ends of the upright, and another end pinned to a sill member intermediate the ends of the sill, said sills, uprights, and braces being constructed of hollow metal tubes with crushed ends at their pivot connections providing a U-shaped cross section configuration with opposite sides of the tube in abutting relation and receiving the pivot connection therethrough, a fence face secured at its ends to said uprights, said fence face being constructed of a metal rod mesh backing and parallel rows of horizontally spaced plastics material slats covering only about 50% of the open mesh area of the backing and said braces holding said uprights at a rearwardly inclined angle of about 15° from a plane normal to the sills.

26. The snow fence of claim 25 including ground anchors securing the ends of the sills to the ground.

27. The snow fence of claim 25 including tubes telescoped into the ends of the sills extending the effective lengths thereof in front of the uprights and in back of the braces.

28. The snow fence of claim 25 including a ground anchored cable attached to an upright.

29. The snow fence of claim 28 including a spring tensioning said cable.

* * * * *